United States Patent [19]

Lenk et al.

[11] Patent Number: 4,784,344

[45] Date of Patent: Nov. 15, 1988

[54] YARN WITHDRAWAL APPARATUS AND METHOD

[75] Inventors: Erich Lenk, Remscheid; Albert Stitz, Kurten, both of Fed. Rep. of Germany

[73] Assignee: Barmag AG, Remscheid, Fed. Rep. of Germany

[21] Appl. No.: 8,490

[22] Filed: Jan. 29, 1987

[30] Foreign Application Priority Data

| | | | |
|---|---|---|---|
| Jan. 30, 1986 | [DE] | Fed. Rep. of Germany | 3602765 |
| Apr. 8, 1986 | [DE] | Fed. Rep. of Germany | 3611740 |
| Apr. 17, 1986 | [DE] | Fed. Rep. of Germany | 3613040 |
| May 2, 1986 | [DE] | Fed. Rep. of Germany | 3614864 |

[51] Int. Cl.[4] ..... B65H 51/20

[52] U.S. Cl. ..... 242/47.01; 226/97; 242/47; 242/47.12; 28/289

[58] Field of Search ..... 242/47.01, 47.08, 47.09, 242/47.1, 47.11, 47.12, 47.13, 47, 18 R, 18 A, 18 PW; 226/97, 34, 24, 168, 184, 108; 28/289

[56] References Cited

U.S. PATENT DOCUMENTS

| | | | |
|---|---|---|---|
| 1,962,029 | 6/1934 | Murphy et al. | 226/184 X |
| 2,539,978 | 1/1951 | Vandijk | 226/184 X |
| 2,667,052 | 1/1954 | Lebocey | 242/47.01 X |
| 2,744,399 | 5/1956 | West | 242/47.12 X |
| 2,885,257 | 5/1959 | Courtney et al. | 226/97 |
| 2,929,179 | 3/1960 | George | 28/289 X |
| 3,083,924 | 4/1963 | Vossen et al. | 242/47.12 |
| 3,144,187 | 8/1964 | Naumann | 226/97 X |
| 3,433,424 | 3/1969 | Rover et al. | 242/47 |
| 4,127,983 | 12/1978 | Munker | 226/97 X |
| 4,638,955 | 1/1987 | Schippers et al. | 242/18 PW |

FOREIGN PATENT DOCUMENTS

| | | |
|---|---|---|
| 1911735 | 6/1970 | Fed. Rep. of Germany . |
| 2633474 | 2/1978 | Fed. Rep. of Germany . |
| 2939716 | 4/1981 | Fed. Rep. of Germany . |
| 3115371 | 2/1982 | Fed. Rep. of Germany . |
| 2302951 | 10/1976 | France . |
| 861140 | 2/1961 | United Kingdom . |

*Primary Examiner*—Stanley N. Gilreath

*Attorney, Agent, or Firm*—Bell, Seltzer, Park & Gibson

[57] ABSTRACT

Advancing yarn is directed onto a larger diameter portion of a tapered yarn winding roll having a smaller diameter free end. The yarn is formed into windings that extend about the roll and that are continuously displaced along its length toward and, in most embodiments also from, its free end. The displacement of the yarn windings may be assisted by air currents and/or the force of gravity. The tension of the advancing yarn may be controlled by varying the axial location of its initial engagement with the roll. The apparatus may consist either of a single yarn withdrawal unit or of multiple interconnected units.

36 Claims, 12 Drawing Sheets

YARN WITHDRAWAL APPARATUS AND METHOD

This invention relates to the handling of textile strand material, hereinafter referred to as yarn. The invention more specifically relates to an apparatus and method for withdrawing continuously advancing yarn.

BACKGROUND OF THE INVENTION

In the course of its manufacture and/or processing, yarn frequently is advanced substantially continuously from a first location, such as a spinning station, to a second location such as a drawing, twisting and/or winding station. Certain of the yarn manufacturing and processing operations may require that the speed and/or tension of the advancing yarn be at desired magnitudes even when the operations are temporarily interrupted for package doffing, equipment maintenance or other causes. During these interruptions the yarn continuously advanced from the first location must be withdrawn from its normal path of travel and diverted to a waste container or other receiver.

Known devices for withdrawing continuously advancing yarn include so-called suction guns and pneumatic injectors which rely solely upon yarn entraining air streams to withdraw the yarn. Such devices have significant limitations. At yarn speeds greater than about 4,000 meters per minute (65–70 meters per second), their use becomes inefficient and unduly expensive. Additionally, such devices can only convey yarn that is under low tension, and therefore cannot be used to maintain or create tension of substantial magnitude in the yarn. In addition to adversely affecting the quality of the withdrawn yarn, this may create other operational problems. For example, when the yarn is being advanced from a godet roll assembly, failure to maintain sufficient tension in the yarn can easily result in the undesirable formation of laps upon the preceding godet roll or delivery rolls by which yarn is conveyed the to the suction gun or injector.

With the foregoing in mind, a primary object of the present invention is the provision of a yarn withdrawal apparatus and method that operate effectively and efficiently at high yarn speeds and that permit control of the tension of the advancing yarn.

Another object is the provision of an apparatus and method, of the aforesaid type, by which the withdrawn yarn may be discharged in any desired one of a plurality of different directions and in either a substantially straight condition or as a mass or tangle of interconnected windings suitable for use in the formation of a bonded web or the like.

SUMMARY OF THE INVENTION

The present invention provides a method and apparatus that realize the aforesaid objects, as well as other benefits, and that employ a winding roll member of tapered shape. The roll is mounted in overhung or cantilever fashion adjacent its larger end portion and has a free opposite end portion of smaller size. Advancing yarn is directed into engagement with the larger diameter end portion of the roll while it is rotated at such a rate as to cause the circumferential speed of the aforesaid roll portion, at the point of its initial engagement with the yarn, to be at least equal to the speed of the advancing yarn. Following initial engagement between the yarn and the roll, helical windings of the yarn are continuously formed upon the roll and are continuously displaced axially thereof to and from its smaller diameter free end.

The winding roll member of the apparatus of the invention preferably is a body of rotation. Particularly preferred are cones, truncated hyperboloids, paraboloids or similar bodies which are truncated in the vicinity of their smallest cross section. When the winding roll is in the form of a cone or truncated cone, its taper or angle of cone (angle of conicity) preferably remains constant over its entire length, but may increase or decrease continuously or in stepwise fashion.

The rate of displacement of the yarn windings axially of the yarn winding roll is primarily a function of the taper or cone angle of the roll and its coefficient of friction with the yarn being withdrawn. If the coefficient of friction of the surface of the roll with the yarn is too low, or if the roll diameter decreases too abruptly, control of the tension upon the advancing yarn will be adversely affected. On the other hand, the desired continuous displacement of the yarn windings toward and from the free end of the winding roll may not reliably occur if the roll diameter decreases too gradually or its coefficient of friction is too large. Suitable values for the roll taper and the friction coefficient of its yarn engaging surface therefore should be determined for each particular intended utilization of the apparatus.

The displacement of the yarn windings is assisted by gravity when the tapered winding roll is mounted in a vertical or other orientation with its free end lowermost. Displacement of the windings axially of the roll may be and normally is also assisted by air streams or currents directed against and along the tapered surface of the roll.

The apparatus of the invention may be designed and constructed either as a hand-manipulated device, or as a stationary device. When employed as a stationary device, the yarn withdrawal apparatus may be mounted such that the axis of its winding roll is vertical or inclined. Axial displacement of the yarn windings is then assisted by gravity, as noted previously. The yarn withdrawal apparatus may also be mounted such that the axis of its winding roll extends horizontally. The horizontal orientation is particularly advantageous when the apparatus is used for the withdrawal of advancing yarn that extends substantially vertically through a yarn entry or threading slot of the apparatus.

The apparatus of the invention preferably includes an axially symmetrical housing within which the winding roll is mounted. A yarn inlet member upon the housing conducts an air flow and the advancing entrained yarn into engagement with the surface of the enlarged end portion of the yarn winding roll. The air flow and yarn extend substantially tangentially relative to the roll at their point of contact with it. Due to the rapid rotation of the winding roll, and the air flow from the yarn inlet, a circumferential air flow is generated about the winding roll. This air flow, the speed of which may be greater than the yarn speed, contributes to the ability of the apparatus to control the tension of the advancing yarn.

In one specific embodiment of the yarn withdrawal apparatus, generation of the circumferential air flow about the rotating winding roll is facilitated by the provision of a helical or spiral groove within the interior wall of the housing of the apparatus. Generation of the circumferential air flow is further facilitated when the confronting surfaces of the interior housing wall and the tapered roll are closely adjacent and are of generally complementary shape.

Yarn windings displaced from the free end of the winding roll may be discharged from the housing of the apparatus directly into a waste receptacle or onto a conveyor or other receiver. However, in various embodiments thereof the apparatus includes a yarn discharge member for receiving the yarn windings displaced from the free end of the tapered roll, and for conducting the resulting yarn in either a straight condition or as a tangled mass of windings, to a desired location. The yarn discharge member may also serve the purpose of changing the direction of movement of the yarn following its axial displacement from the free end of the winding roll. To this end, the discharge member may have the form of a right angle duct member. Alternatively, the yarn discharge member may consist of a cup-like housing extension having a blind bore or recess underlying the free end of the winding roll so as to receive the yarn windings displaced from it. The yarn received within the blind recess member exits tangentially from it, for further treatment, processing or disposal, through a channel-like opening extending laterally from the blind recess.

The yarn inlet member of the apparatus may be so inclined relative the winding roll as to cause the entering yarn to possess a component of motion directed toward the free end of the roll, as well as a motion component directed circumferentially about the roll. This assists in ensuring that the yarn windings formed upon the roll extend at a desired inclination or pitch angle relative to the roll axis. When the housing of the apparatus is of the previously described type having a helical or spiral groove upon its interior surface, the air discharged from the yarn inlet member is preferably directed into and longitudinally of the yarn entry end of such groove.

The yarn inlet member of the apparatus of the invention may be so constructed as to catch an advancing yarn if it should be cut or broken. To this end, in certain embodiments the yarn inlet member includes or consists of a threading slot in the housing of the apparatus. The slot extends in a plane intersecting the roll and is sufficiently long as to permit an unbroken running yarn to be brought into tangential contact with the winding roll. If the yarn should break or be cut at a downstream location, yarn tension will drop to zero and the yarn in tangential contact with the roll will form a lap or wrap on the roll and will thus be caught, and then withdrawn, by the winding roll of the apparatus. If the yarn is advancing from a godet roll, its withdrawal by the apparatus occurs so rapidly after breakage as to prevent the formation of yarn laps on the upstream godet roll.

When the yarn withdrawal apparatus of the present invention is used for yarn withdrawal during interruptions in the yarn manufacturing or processing operation, the apparatus may be constructed as a handheld device and used to catch the yarn, remove the waste sections of it, and thereafter effect reestablishment of the desired yarn line, in a manner similar to the conventional suction guns.

A particularly difficult yarn withdrawal situation is presented by processing installations that require simultaneous handling of a plurality of yarns advancing toward separate locations. Such a situation is presented during package doffing of a package forming machine having a plurality of stations to which yarns are continuously advanced from a spinning station. Illustrative of such installations, which have thus far operated at yarn speeds of less than 4,000 meters per minute, are those disclosed in U.S. Pat. No. 4,638,955, which is owned by the assignee of the present application. A yarn withdrawal apparatus of the present invention that is particularly adapted for use in association with such an installation consists of a plurality of axially aligned and interconnected yarn withdrawal units. The units receive respective ones of the advancing yarns, and have central ducts or passageways that communicate with one another such that the withdrawn yarn discharged from each "upstream" unit passes sequentially to and through each "downstream" unit.

When used for withdrawing yarns traveling at high speeds such as from 3,000 to 4,000 meters per minute, while maintaining yarn tension, an apparatus in accordance with the present invention is much more efficient and requires much less power than the pneumatic devices heretofore employed.

In a tension-controlling embodiment of the present apparatus, the inlet member that guides advancing yarn into the apparatus housing is adjustable axially of the winding roll within the housing. This permits adjustive movement of the inlet member toward the smaller end of the winding roll for the purpose of facilitating commencement of the formation of yarn windings upon the roll. Once the formation of yarn windings upon the roll has been satisfactorily commenced, the yarn inlet member can be axially displaced toward the larger roll to achieve the desired yarn tension. Additionally or alternatively, the yarn tension may be monitored and automatically maintained by adjusting the axial position of the yarn inlet member as a function of the monitored yarn tension.

DESCRIPTION OF THE DRAWINGS

Other features of the invention will be apparent from the following description of illustrative preferred embodiments thereof, which should be read in conjunction with the accompanying drawings, in which.

DESCRIPTION OF THE PREFERRED EMBODIMENTS

Figure 1:
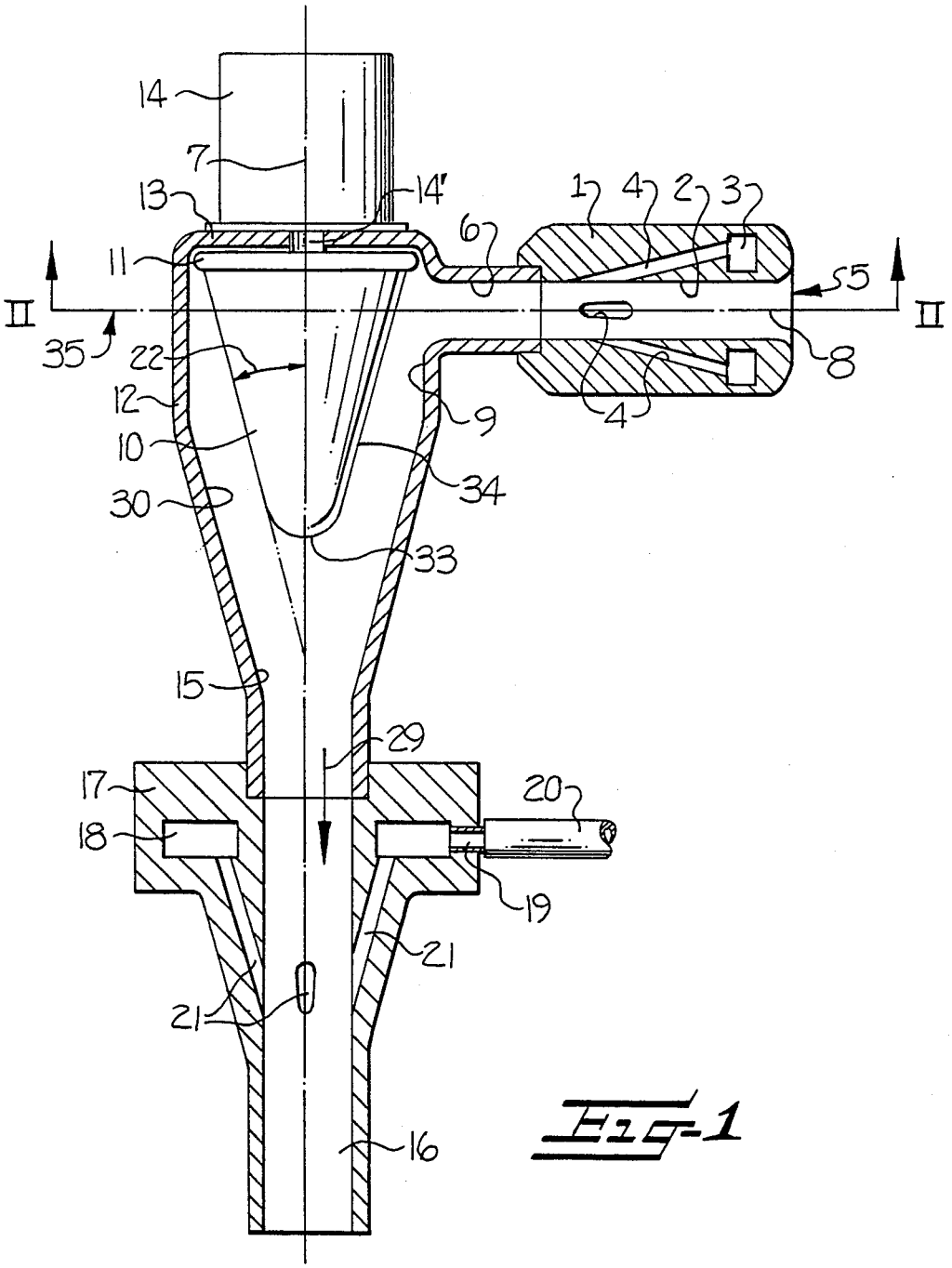
FIG. 1 is a longitudinal sectional view of a yarn withdrawal apparatus constructed in accordance with and adapted for the practice of the present invention.
Figure 2:
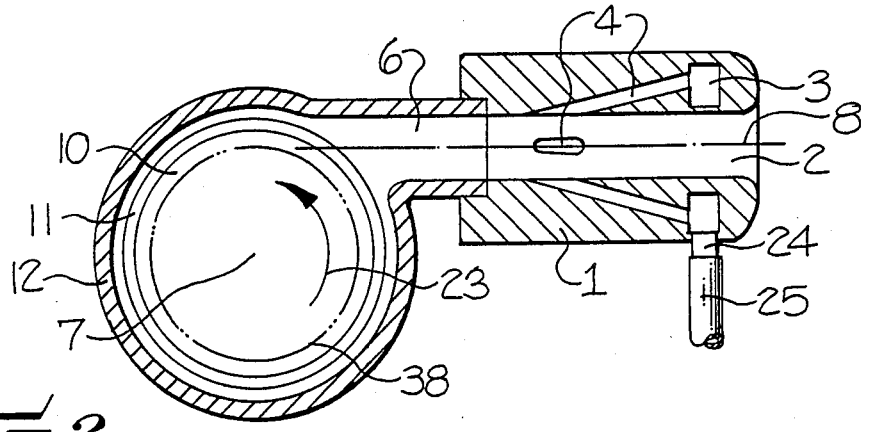
FIG. 2 is a transverse section taken substantially along the line II—II and rotated ninety degrees, through the apparatus of FIG. 1.

Referring more particularly to the drawings, the yarn withdrawal apparatus illustrated in FIGS. 1 and 2 includes elongate housing means 12; a tapered winding roll member 10 mounted within housing 12 for rotation about its central and illustratively vertical axis 7; drive means 14 for imparting rotation to roll 10; and yarn conducting means, illustratively in the form of pneumatic injector assemblies 1, 17 and housing ducts 6, 15, for conducting yarn into and from housing 12.

Roll 10 is supported adjacent the upper or yarn entry portion 9 of housing 12 by a drive shaft 14' that extends through the top housing cover or wall 13 and is connected to the drive means 14 mounted upon such cover. The drive means may be a high speed electric motor, preferably of the three phase asynchronous type.

Yarn winding roll 10 is a body of revolution having the general shape of a truncated cone. In the vertical orientation of the apparatus shown in FIG. 1, the enlarged diameter portion of roll 10 is uppermost, and is disposed adjacent yarn inlet duct 6 of housing 12. The lower and smaller diameter portion of roll 10 has a rounded free end 33 whose curved surface merges smoothly with the uniformly sloping conical surface 34 of the roll. A circumferential bead 11 upon the upper end of roll 10 is located closely adjacent the side wall of housing 12 so as to prevent yarn from entering the space between the roll and housing cover 13, and there possibly becoming entrained about roll drive shaft 14'.

Yarn conveying injector 1 is secured in any suitable manner to housing inlet duct 6 and has a central bore-like passageway 2 communicating with such duct and in axial alignment with it. An annular duct 3 of injector 1 communicates via a fitting 24 (FIG. 2) and line 25 with a compressed air source (not shown). A plurality of angularly extending air channels 4 communicate at one end with annular duct 3 and at their opposite end with the central injector passageway 2. During operation of injector 1 the air discharged from channels 4 creates a high velocity air flow that passes into and through the inlet opening 5 and the central passageway of the injector, and then into and through housing duct 6. That part of the air flow between injector inlet 5 and the outlets of injector channels 4 is suction induced by the air discharged from the channels 4.

The other injector 17 similarly has a central passageway 16 into which open a plurality of inclined channels 21 that extend to an annular duct 18 communicating via a fitting 19 with a line 20 connected to a pressurized air source (not shown). Injector 17 is connected to and axially aligned with the lower yarn discharge portion or duct 15 of housing 12. Operation of injector 17 causes air to flow in the direction (vertically downward, in the illustrated orientation of the apparatus) indicated by the arrow 29 of FIG. 1 through injector passageway 16, discharge duct 15 of housing 12, and also through a transitional portion 30 of housing 12.

The numeral 35 in FIG. 1 identifies the horizontal plane (hereinafter referred to as the normal plane) that extends normal to the central axis 7 of roll 10 and housing 12, and that contains the inlet axis or line 8 along which passes yarn (not shown) introduced into housing 12 via injector 1 and housing duct 6. Injector 1 and duct 6 might be laterally centered with respect to housing 12, in which case the axes 7, 8 would intersect. Preferably, however, injector 1 and duct 6 are disposed such that the axis 8 is laterally offset from the central axis 7 of roll 10 and housing 12. As viewed in FIG. 2, the offset is to the left when the direction of roll rotation is as indicated by the arrow 23. The offset preferably is such that yarn advanced along axis 8 into housing 12 engages the conical surface of roll 10 substantially tangentially at a point of engagement 38 located within the normal plane 35 (FIG. 1) passing through the enlarged upper end portion of roll 10. Within the plane 35 containing the point of initial yarn contact 38, the circumferential speed imparted to roll 10 by drive means 14 is at least equal to the linear speed of the advancing yarn, and preferably is greater than the yarn speed. In addition to driving roll 10 at the desired speed, drive means 14 also provides torque sufficient to maintain the desired yarn tension at such speed.

Upon engagement with roll 10, the yarn entering housing 12 is propelled by the roll in the direction of its circumferential rotation. This results in the formation of spiral yarn windings about the periphery of the roll. Such windings are continuously displaced in an axial direction along the roll from its large diameter upper end portion to its smaller diameter lower portion and free end 33, from which the windings pass. The yarn is then withdrawn from housing 12 by and through injector 17. Depending upon the velocity of the air flow within injector 17, the yarn discharged through it may either be substantially straight or in the form of tangled windings.

The axial displacement of the yarn windings along and from roll 10 is caused in part by the tapered conical shape of the roll. To this end the cone angle 22 of the roll (FIG. 1) is greater than the angle of friction between the yarn and the roll surface. The angle of friction as used herein may be defined by its relationship to the coefficient of friction, namely, the tangent of the angle of friction equals the coefficient of friction. The angle of friction is also defined below with respect to FIG. 15. Such displacement of the windings is assisted by an air flow, produced within housing 12 by the action of injector assemblies 1, 17, directed along the tapered surface of roll 10 toward its free end 33 and yarn discharge portion 15 of housing 12. When housing 12 is vertically oriented with its yarn discharge portion 15 lowermost, as shown in FIG. 1, displacement of the yarn windings along and from roll 10 is further assisted by the action of gravity. The frictional forces between the yarn windings and the surface of roll 10 normally are rather low. This is due both to the roll surface having a relatively low coefficient of friction with the yarn, and to the tendency of the yarn windings to be moved radially outwardly from the roll by the action of centrifugal force.

During operation of the apparatus of FIGS. 1 and 2, roll 10 is driven by drive means 14 and air currents are produced by operation of injector assemblies 1, 17. Yarn (not shown) is pneumatically conducted into housing 12 through injector 1 and housing duct 6. The yarn engages the tapered surface of roll 10 substantially tangentially at a point of contact with the normal plane 35 extending through the larger diameter portion of the roll. Spiral windings of the yarn are formed upon the roll. The taper of the roll, the air current within the adjacent portion of housing 12, and the force of gravity collectively effect displacement of the yarn windings along the length of roll 10 to and from its free end 33. The yarn is then pneumatically discharged from the apparatus through housing duct portion 15 of the central passageway 16 of injector assembly 17.

In the hereinafter presented description of other embodiments of apparatus in accordance with the invention, elements identical or similar to ones previously described are designated by the same reference numerals with suffix letters or numbers added thereto.

Figure 3:
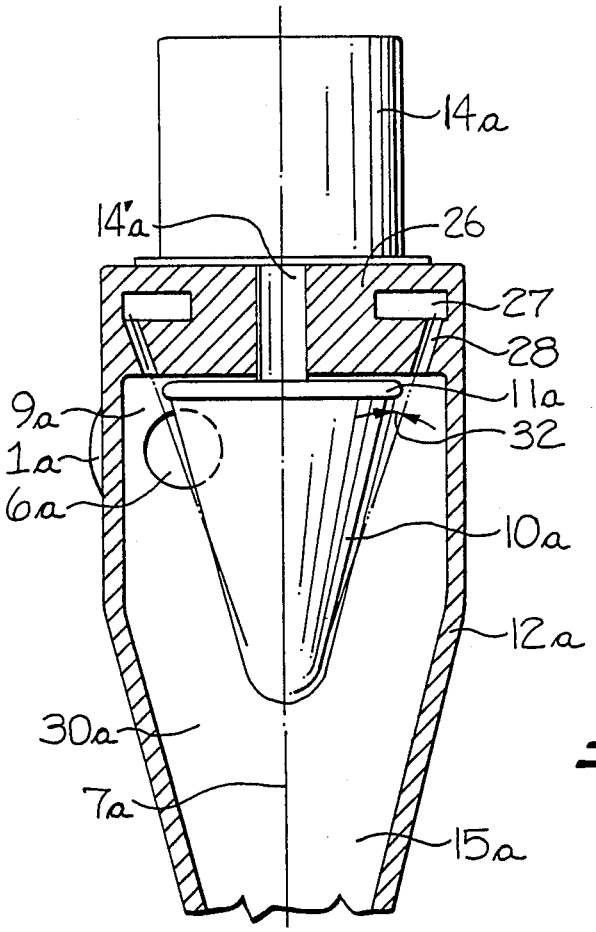
FIG. 3 is a fragmentary longitudinal sectional view of the housing component of another embodiment of the apparatus.

In the embodiment of the apparatus shown in FIG. 3, the top cover plate or wall 26 of housing 12*a* is provided with an annular duct 27 connected to a suitable source (not shown) of pressurized air. Air channels 28 extend downwardly from duct 27 at spaced locations about its circumference. The channels 28 open from the lower surface of housing cover 26 adjacent the periphery of winding roll 10*a*, and extend angularly relative to the central axis 7*a* of roll 10*a*. During operation of the apparatus jets of air exiting from channels 28 extend either approximately parallel to the conical roll surface within the upper housing portion 9*a*, or contact the same at an acute angle 32. The jets of air from channels 28 further assist in displacing the yarn windings formed upon roll 10*a* along the length of such roll and through the yarn discharge portion 15*a* of housing 12*a*.

Figure 4:
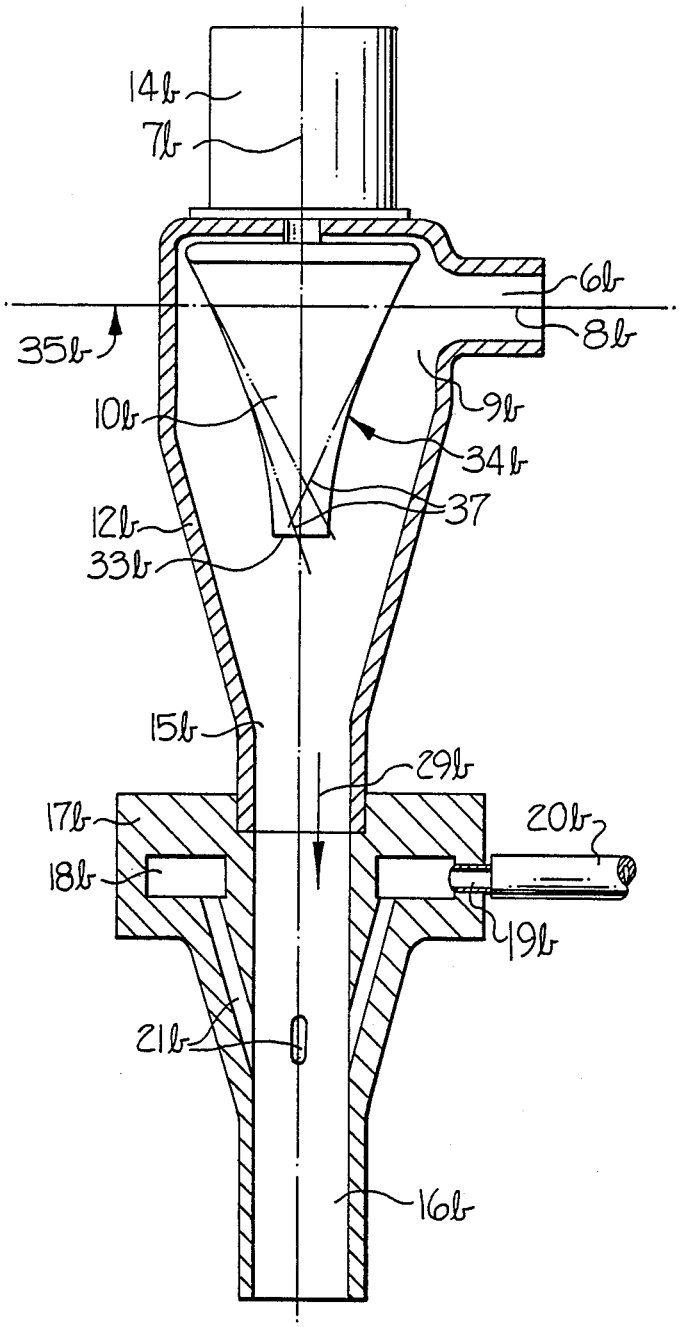
FIG. 4 is a longitudinal sectional view of another embodiment of the apparatus.

The embodiment shown in FIG. 4 differs from that of FIGS. 1 and 2 in that a pneumatic injector assembly is not connected to yarn inlet duct 6*b* of housing 12*b*. In this situation, the inwardly directed flow of yarn entraining air through duct 6*b* is produced entirely by the suction effect of the injector 17*b* connected to yarn discharge portion 15*b* of housing 12*b*. Additionally, the tapered roll 10*b* differs in shape from the previously described roll 10 (FIGS. 1–2) in that its tapered exterior surface is concave in the area of its lower portion 34*b*, and its free end 33*b* is flat rather than curved. The angle defined between the roll axis 7*b* and the lines 37 extending tangentially to the concave surfaces of the roll are greater than the associated angle of friction.

Figure 5:
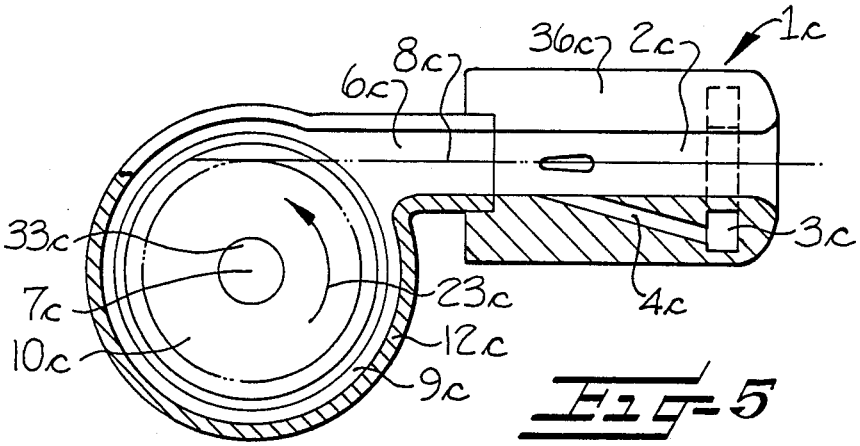
FIG. 5 is a transverse sectional view, similar to FIG. 2, of another embodiment of the apparatus.

In the alternative embodiment of FIG. 5, the apparatus is provided with a yarn threading or inserting slot 36*c* that makes it possible to retrieve an advancing yarn at any desired location along its path of travel. As shown in FIG. 5, slot 36*c* communicates with and extends along the entire length of the central passageways of injector 1*c* and housing inlet duct 6*c*. Slot 36*c* also extends through and sufficiently about the wall of housing 12*c* as to ensure that yarn passing therethrough in tangential relationship to the tapered surface of the larger diameter portion of roll 10*c* will not contact the terminal end of the slot. Withdrawal of the yarn by roll 10*c* commences automatically if the yarn should break or be cut downstream from the apparatus. The annular air duct 3*c* of injector 1*c* of course does not extend through 360°, as in the case of the duct 3 shown in FIGS. 1 and 2, but rather terminates short of slot 36*c*.

Figure 6:
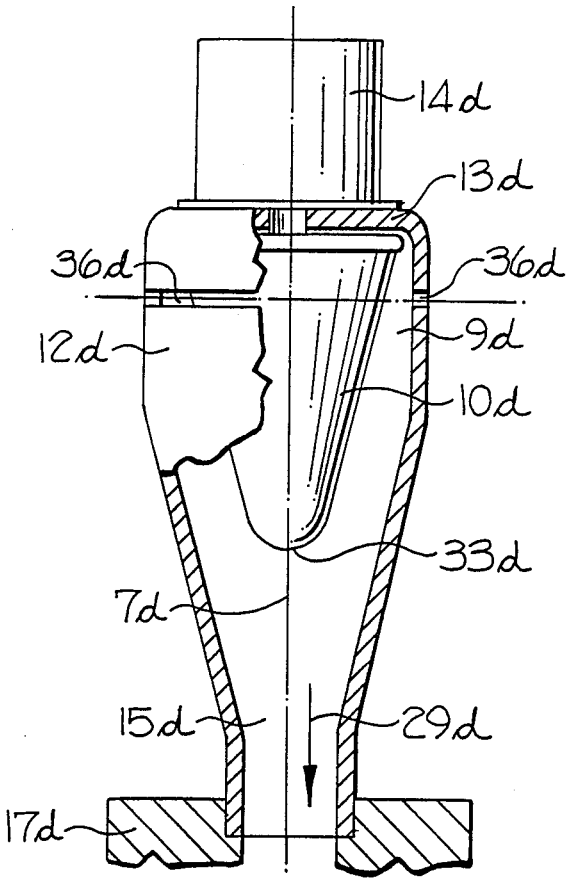
FIG. 6 is a fragmentary view, primarily in a longitudinal section but partially in elevation, of the housing and immediately adjacent components of another embodiment of the apparatus.

The apparatus of the FIG. 6 embodiment does not have an injector 1 and inlet duct 6 such as are associated with the apparatus of the embodiment of FIGS. 1 and 2. In lieu thereof, the housing 12*d* of the FIG. 6 apparatus is provided with a threading slot 36*d* through which advancing yarn (not shown) is adapted to freely pass. The injector 17*d* associated with yarn discharge duct 15*d* of housing 12*d* creates, by a suction effect, an air flow through slot 36*d* and into yarn inlet portion 9*d* of the housing. The air flow assists in initiating withdrawal of the yarn, upon separation of it downstream from the apparatus, by winding roll 10*d*. The air flow also assists in the axial displacement of the yarn windings formed by and upon the roll, and conveys such windings from the housing following their passage from the free end 33*d* of the roll.

Figure 7:
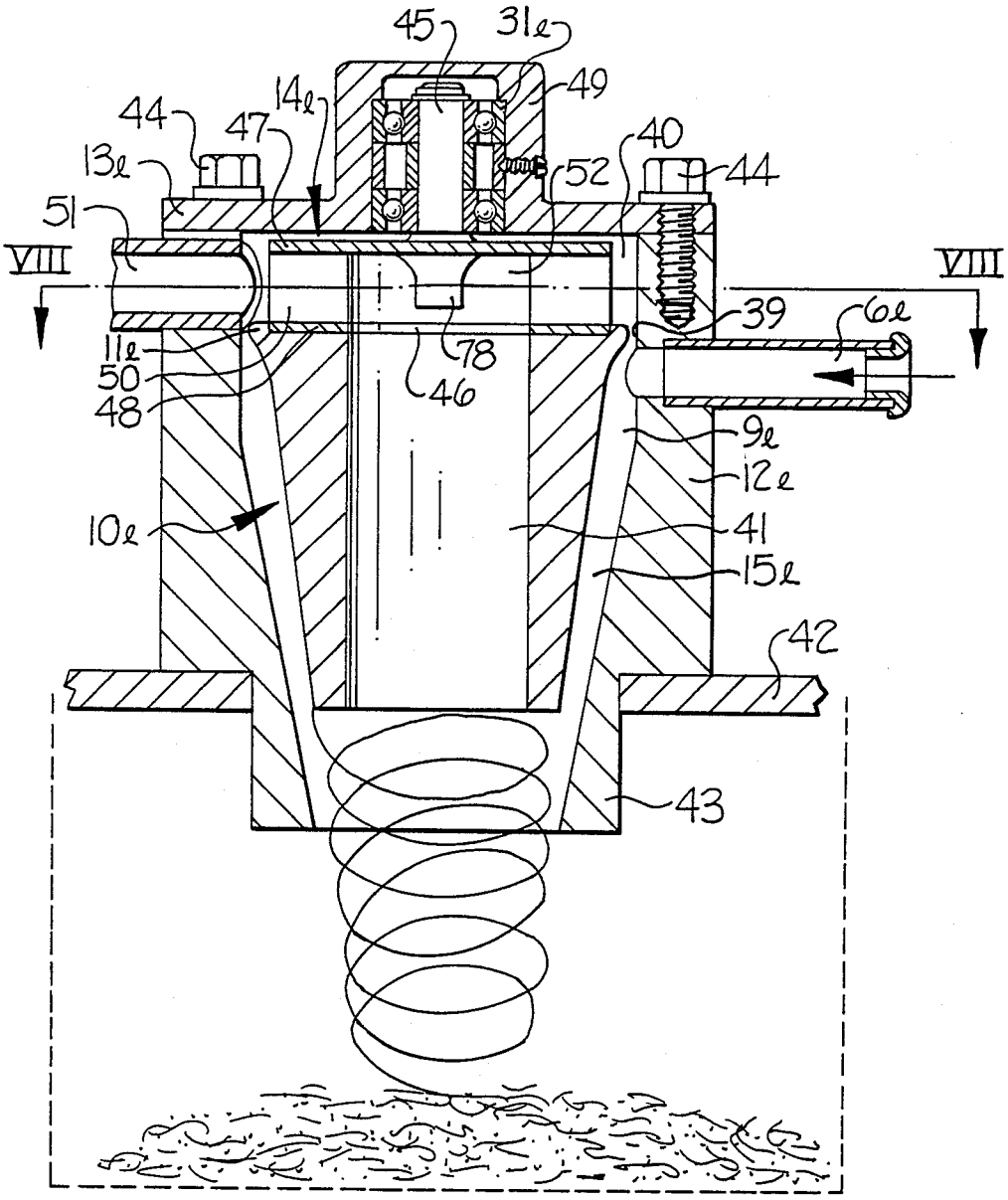
FIG. 7 is a longitudinal sectional view of another embodiment of the apparatus, and of a schematically and fragmentarily illustrated waste container.
Figure 8:
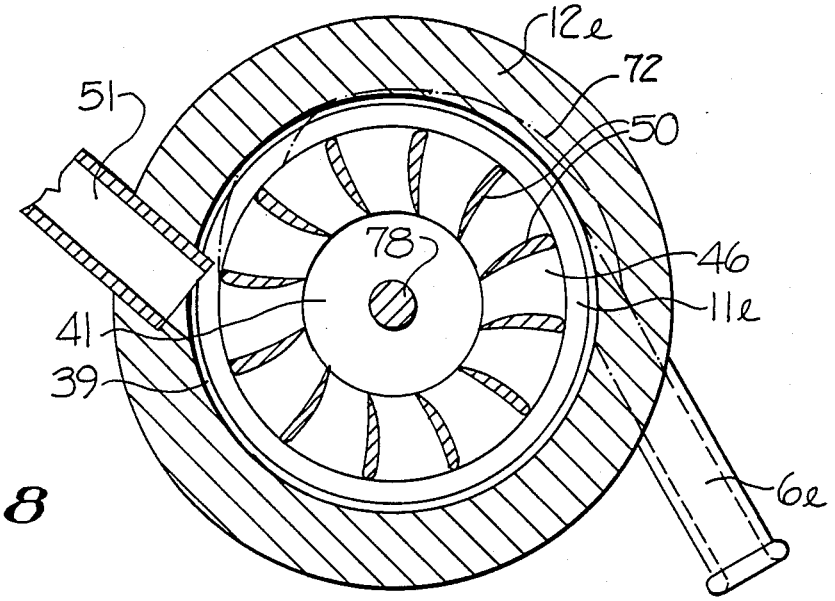
FIG. 8 is a transverse section taken substantially along the line VIII through the apparatus of FIG. 7, and also showing in phantom lines a feature of the apparatus of FIG. 7A.

In the embodiment thereof shown in FIGS. 7 and 8, the apparatus is pneumatically powered and is mounted upon a waste container 42 having an opening that receives a tubular extension 43 of the housing 12*e* of the apparatus. The interior of housing 12*e* is cylindrical in its upper portions 40, 9*e*, and is conical in its remaining portions. A turbine wheel 46, having upper and lower disc-like members 47, 48 between which a circular array of blade elements 50 is secured, is fixedly connected to the upper surface of tapered yarn winding roll 10*e* of the apparatus. A shaft 45 extending from upper disc 47 of turbine wheel 46 is received by bearings 31*e* mounted within an upwardly projecting portion 49 of a cover plate 13*e* secured by bolts 44 to the top of housing 12*e*. Bearings 31*e* mount shaft 45, and thus turbine wheel 46 and tapered roll 12*e*, for rotation in unison with each other about the central axis of the apparatus. Rotation is imparted to the foregoing components by high velocity air conducted into the chamber-like housing portion 40 from a compressed air source (not shown) by a duct 51 that is adjacent and generally tangential to the periphery of wheel 46 and its blades 50. Part of the air thus introduced into the uppermost portion 40 of the interior of housing 12*e* passes between blades 50 of wheel 46 into the central portion 52 of the wheel, where it engages and is deflected downwardly by the curved surfaces of a pin element 78 depending from upper disc 47 of wheel 46. Such air then passes through a central opening within disc 48, and through a therewith aligned central passage 41 provided within winding roll 10*e*. The remaining air introduced into housing chamber 40 is discharged downwardly therefrom at relatively high velocity through an annular nozzle or gap 39 defined by and between winding drum bead 11*e* and the thereto closely adjacent confronting surface of the side wall of housing 12*e*. The air from gap 39 passes downwardly along the conical tapered surface of roll 10*e* within the space between such surface and the confronting interior surface of housing 12*e*. Along a substantial part of its lower portion, the latter housing surface is also of conical or tapered configuration. While the angle of taper of the confronting conical surfaces of roll 10*e* and the interior wall of housing 12e may be the same, illustratively they differ such that the annular space between such surfaces decreases in width toward the free end of winding roll 10e.

During operation of the apparatus of FIG. 7, air introduced through duct 51 effects rotation of turbine wheel 46 and the roll 10e. The downward passage of such air from wheel 46 and interior chamber 40 of housing 12e creates a yarn entraining inward flow of air through inlet duct 6e of the housing. Yarn introduced by the air flow substantially tangentially onto the conical exterior surface of roll 10e is formed into windings, in the same manner as in the previously described embodiments. Such windings are displaced axially along and from the free end of roll 10e by, among other things, the downwardly directed air flow within the annular space between the confronting conical surfaces of the roll and the interior wall of housing 12e. Following their passage from the lower free end of roll 10e, discharge of the yarn windings through housing extension 43 is further assisted by the air flowing downwardly from the interior central passageway 41 of the roll.

Figure 7A:
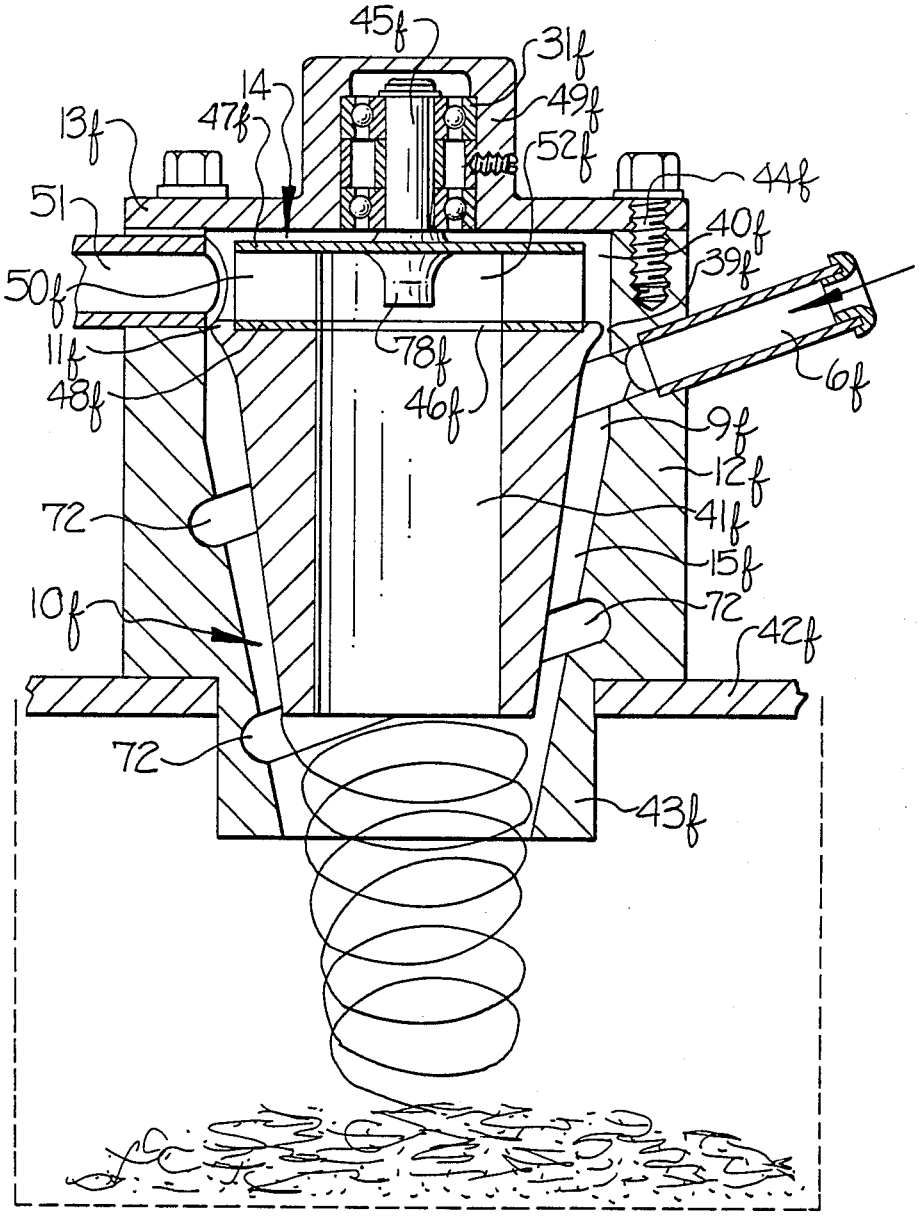
FIG. 7A is a longitudinal sectional view similar to FIG. 7 but showing another embodiment of the apparatus.

The embodiment of the apparatus shown in FIG. 7A differs from that of FIG. 7 in only two respects. Firstly, a spiral groove 72 is provided within the interior wall of housing 12f. Secondly, the yarn inlet duct 6f of housing 12f is inclined toward the lower, yarn discharge end of the housing. Duct 6f is aligned with the upper part of housing groove 72, and preferably has substantially the same slope as the groove relative to the central axis of the housing. The foregoing arrangement assists in ensuring that the air flow within housing 12f will have components extending both axially of and circumferentially about roll 10f, and thus will assist in both the formation and the displacement of the desired yarn windings upon and along the roll. The housing groove 72 is also indicated by phantom lines in FIG. 8 of drawings.

Figure 9:
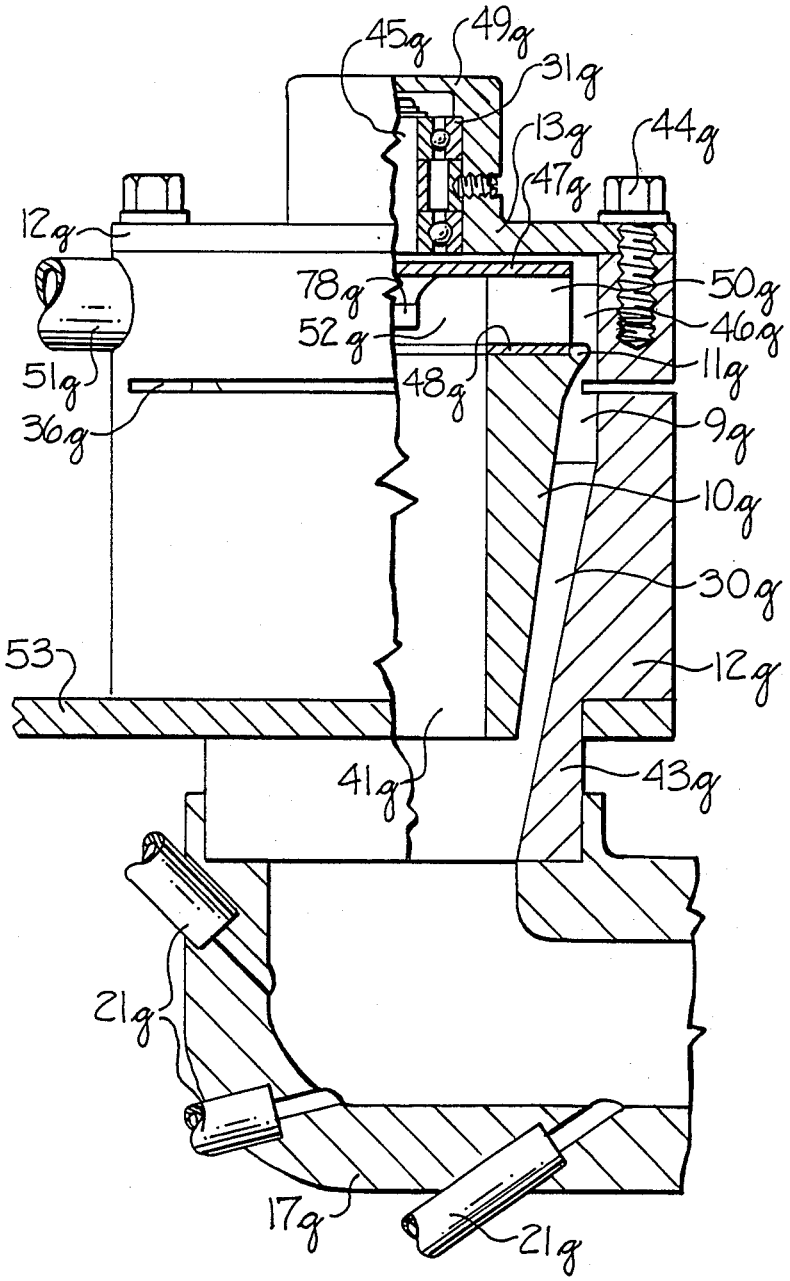
FIG. 9 is a view, partially in longitudinal section and partially in elevation, of another embodiment of the apparatus.

The yarn withdrawal apparatus of FIG. 9 differs from that of FIGS. 7 and 8 in three respects. The housing 12g of the apparatus has a yarn entry or threading slot 36g in lieu of the yarn entry duct 6e of the FIG. 7 embodiment. The length of slot 36g is preferably such that yarn received within it can be brought into circumferential contact with winding roll 10g at a suitable looping angle of, for instance, 60°. Secondly, the yarn discharged from housing 12g does not pass into a waste container, as in the case of the FIG. 7 apparatus, but rather into a yarn discharge duct 17g connected to the extension 43g of housing 12g. Duct 17g has the shape of an elbow or right angle member, and is provided with a plurality of air injector elements 21g that are inclined toward its outlet end. The apparatus of FIG. 9 is adapted to be mounted in a horizontal or other desired orientation by a mounting bracket 53 secured to housing 12g adjacent its extension 43g. The FIG. 9 apparatus operates substantially the same as that of FIG. 7 except that yarn enters the housing through threading slot 36g, rather than through an inlet duct, and the air injectors 21g associated with duct 17g create a suction effect that enhances the axial air flow within housing 12g. Injectors 21g of course also move yarn discharged from housing 12g through duct 17g. The number, inclination and location of injectors 21 may be such as to cause the yarn windings discharged from housing 12g to again be drawn out to a substantially straight condition. Ordinarily, however, the yarn conducted through and from duct 17g would be in the form of a tangled mass of windings.

Figure 10:
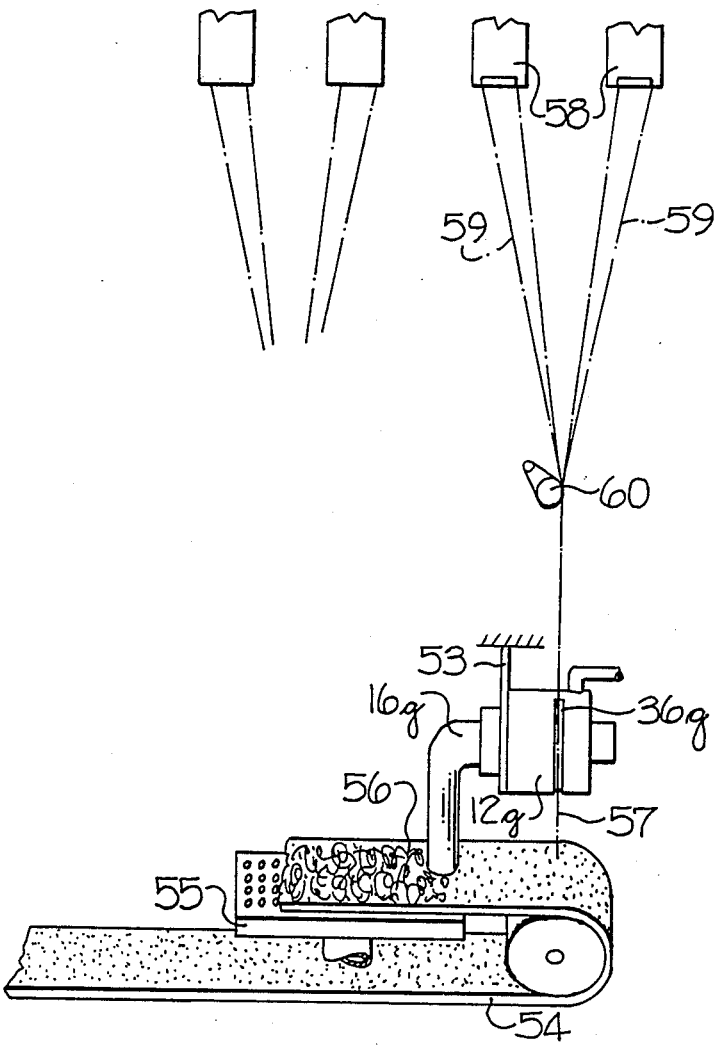
FIG. 10 is a partially schematic perspective view showing the apparatus of FIG. 9 receiving yarns from a feeding system, and discharging such yarns onto a web forming conveyor.

FIG. 10 of the drawings shows an apparatus of the FIG. 9 type receiving multifilament yarns 59 advanced at a constant speed from spinning heads or other sources 58 by a delivery system 60. The delivery speed of the yarns is such (more than 4,000 meters per minute) that the yarns are fully oriented. The yarns advancing from delivery system 60 enter housing 12g through slot 36g, and are withdrawn continuously by the winding roll 10g (FIG. 9) within the housing. The yarn windings discharged from the lower end of duct 17g of the apparatus are received upon a perforated moving conveyor belt 54 underlaid by a suction device 55. Uniform lateral distribution of the yarn discharged upon conveyor 54 may be achieved by utilizing support bracket 53 to impart oscillatory motion to the apparatus, as indicated by the double-headed arrow 56, about a vertical axis 57 extending through housing slot 36g. When the oscillatory motion is about such an axis, the yarn intake conditions do not change as a result of such motion. The web thus formed by the fibers deposited upon conveyor 54 is flattened and pressed against the conveyor belt by the suction of device 55. Conveyor 54 advances the web, as it is formed, to a desired station where it is subjected to further processing such as additional compacting and/or bonding.

Figure 11:
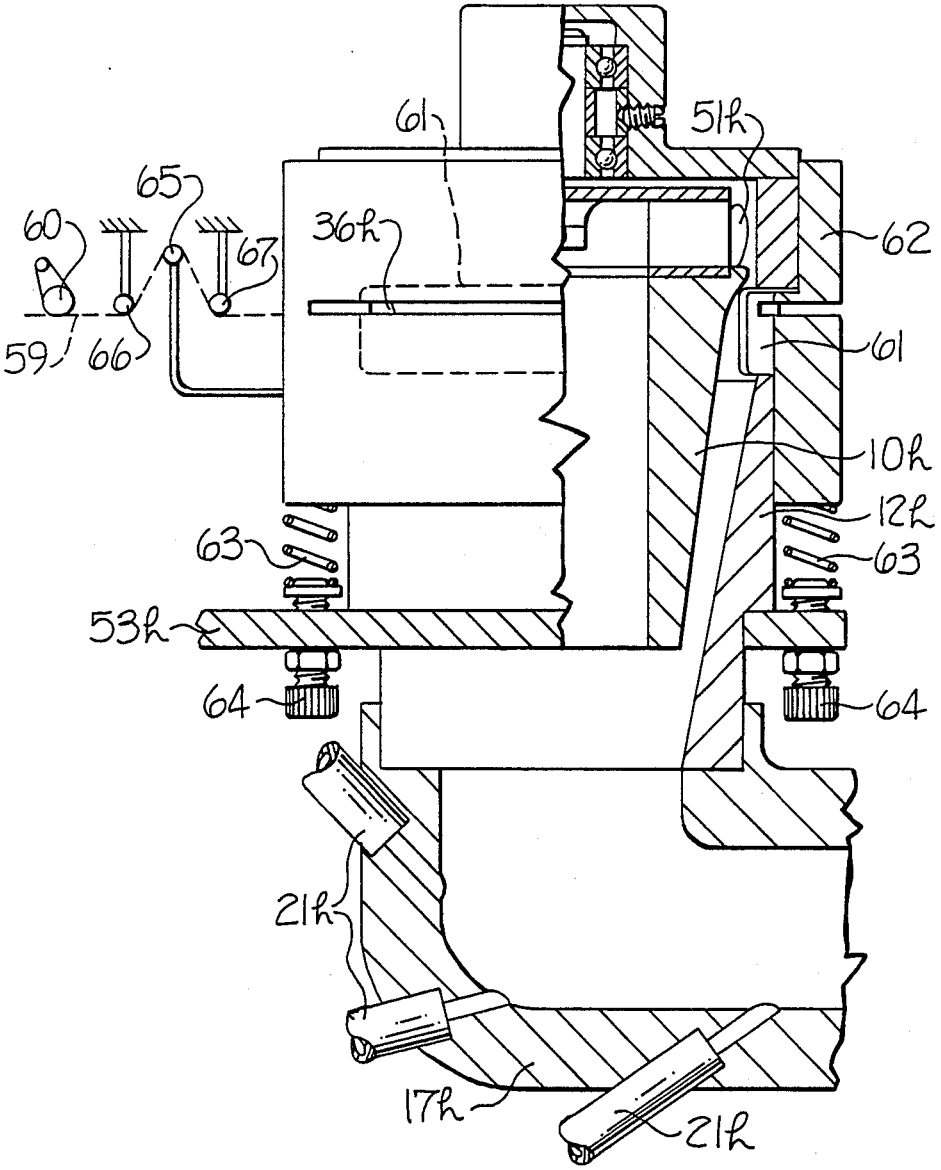
FIG. 11 is a view primarily in longitudinal section, but partially in elevation, of another embodiment of the apparatus in association with a schematically illustrated yarn feeding and guide system.

The apparatus of FIG. 11 is substantially the same as that of FIG. 9 except for its additional inclusion of means for monitoring and automatically controlling the tension of the yarn received by it. More specifically, the housing 12h of the FIG. 11 apparatus is encircled by an annular jacket 62 that is slidably movable in an axial direction relative to the housing. Spring means 63 carried by the apparatus mounting bracket 53h bias jacket 62 toward its illustrated rightmost position, while permitting leftward sliding movement thereof toward bracket 53h against the biasing force of spring 63. The force of the aforesaid spring may be adjusted by rotation of adjustment screws 64 carried by bracket 53h and supporting the adjacent end of spring 63. A relatively wide yarn entry or threading slot 61 is provided within the side wall of housing 12h. Such slot is overlaid by a narrower slot 36h provided within jacket 62. Slot 36h is so narrow that yarn extending through it is displaced axially of the apparatus by relatively small movement of jacket 62. When jacket 62 occupies its illustrated rightmost position, slot 36h is spaced in an axial direction adjacent the rightmost edge of slot 61 and adjacent the large diameter end of yarn winding roll 10h. A yarn guide 65 is attached to jacket 62. Yarn 59 advancing from a delivery system 60 through slots 36h, 61 and onto winding roll 10h of the apparatus first passes about and is tensioned between stationary yarn guides 66, 67, on the one hand, and the yarn guide 65 which is movable with jacket 62, on the other hand. Increases in the tension of the yarn advancing toward the apparatus deflect its yarn guide 65 and jacket 62 leftwardly, against the biasing force of spring 63. As jacket 62 moves to the left, however, its slot 36h displaces the entering yarn axially of roll 10h in a leftward direction. This results in the initial contact of the entering yarn with roll 10h being at a peripheral portion thereof having a smaller diameter and therefore a slower circumferential speed of rotation. Consequently, the tension of the yarn is reduced until the jacket position is such that equilibrium is again reached between the yarn tension, on the one hand, and the force of spring 63, on the other hand. Maintenance of yarn tension of a desired magnitude, which of course should be large enough to avoid formation of a laps on the roll of delivery system 60, can therefore be achieved by appropriate presetting of the force of spring 63 by adjustment of screws 64.

Figure 12:
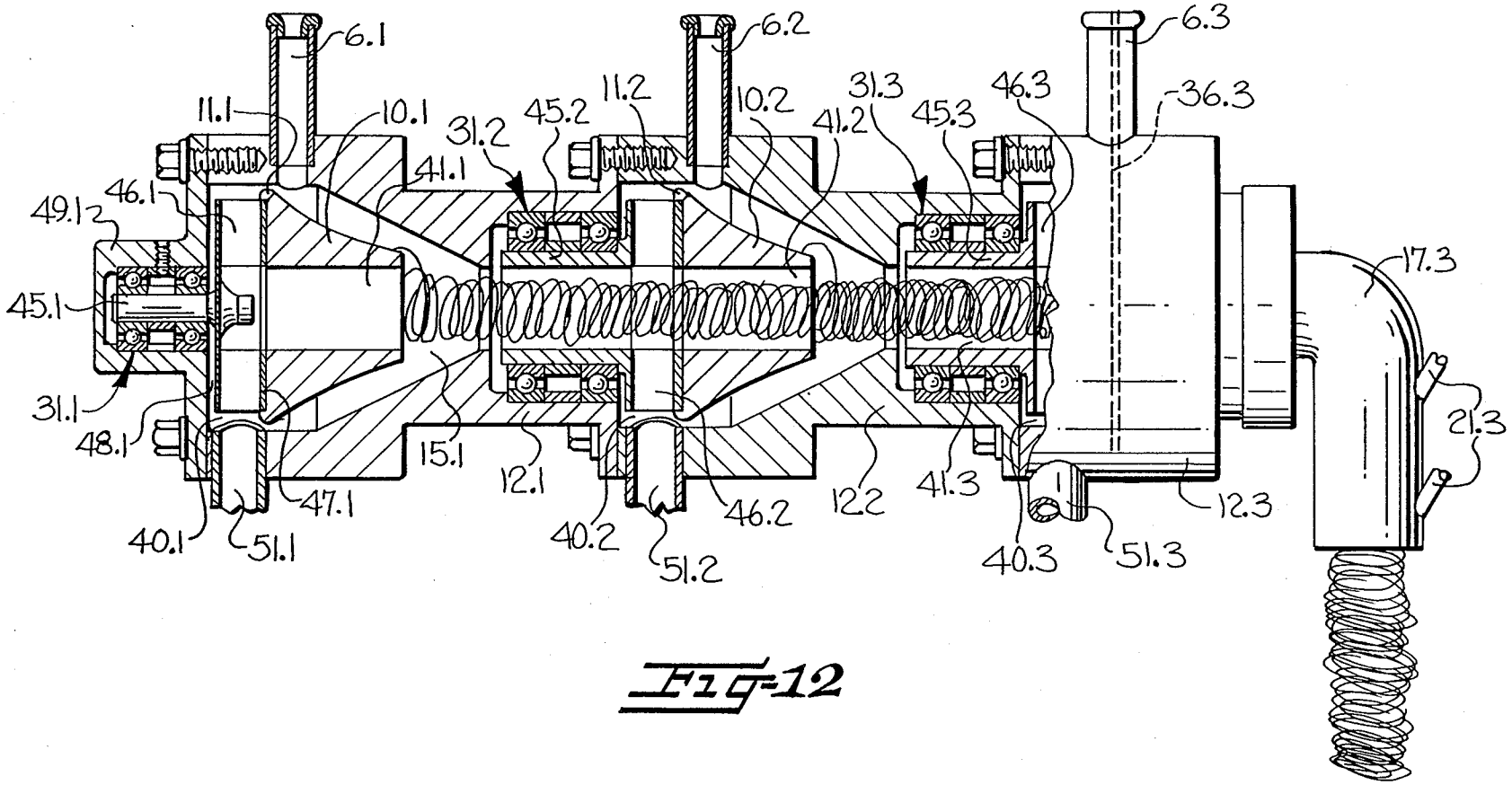
FIG. 12 is a view primarily in longitudinal section, but partially in elevation, of another embodiment wherein the yarn withdrawal apparatus includes a plurality of axially aligned and interconnected yarn withdrawal units.

The yarn withdrawal apparatus of FIG. 12, to which reference is now made, includes a plurality (illustratively three) of axially aligned and sequentially interconnected yarn withdrawal units. Other than adjacent its outlet (right) end, the first or leftmost unit is of substantially the same construction as the apparatus shown in FIG. 7 of the drawings. The second and third units differ from the first unit primarily in that the shafts 45.2 and 45.3 thereof are of enlarged diameter, and the central passageways 41.2, 41.3 of their winding rolls also extend through the shafts 45.2, 45.3 and the turbine wheels 46.2, 46.3 respectively secured thereto. To accommodate the larger diameter of the hollow shafts 45.2, 45.3, the bearings 31.2, 31.3 associated therewith are of course also of larger diameter than the bearings 31.1 of the first yarn withdrawal unit. The yarn discharge duct within the right end of the housing 12.1, 12.2, 12.3 of each unit preferably and illustratively is of the same diameter as the passageways 41.1, 41.2, 41.3. The last (rightmost) unit differs from the center one only in that the discharge duct of its housing 12.3 is foreshortened, and is connected to an elbow-shaped duct 17.3 having pneumatic injectors 21.3. During operation of the FIG. 12 apparatus, each unit receives yarn through its inlet duct 6.1, 6.2, 6.3. The yarn windings formed upon and displaced from winding roll 10.1 of the first (leftmost as viewed in FIG. 12) unit are discharged into the central passageway 41.2 through shaft 45.2, wheel 46.2 and roll 10.2 of the center unit. The yarn windings formed upon roll 10.2 of the center unit, from the yarn introduced therein through inlet duct 6.2 thereof, are discharged from such unit with the yarn windings received from the first unit. These are received by the central passageway 41.3 of the third (rightmost, as viewed in FIG. 12) unit. Such windings are then discharged, together with those formed within the third unit from yarn introduced therein through inlet duct 6.3, into an elbow-shaped discharge duct 17.1 equipped with injector elements 21.1 connected to a pressurized air source (not shown). Injectors 21.3 convey the mass of yarn windings through duct 17.1, and by a suction effect increase the air flow into and through each of the three upstream yarn withdrawal units of the apparatus. A threading or yarn entry slot 36.3 may be and illustratively is provided in association with the housing 12.3 and yarn inlet duct 6.3 of the third (rightmost) unit of the FIG. 12 apparatus. Similar yarn entry slots may be provided in association with each of the other two units of the apparatus, and should be so provided when the introduction of yarn therein is to be by lateral partial looping of the yarn about the yarn winding rolls of the units. Illustrative of such a situation would be when the FIG. 12 apparatus was used during periods of package doffing for handling a plurality of yarns normally advanced to a package forming station.

The yarn withdrawal apparatus shown in FIG. 12 could of course be extended to accommodate more than three units simply by providing, between the two end units, additional units corresponding to the illustrated center one.

Figure 13:
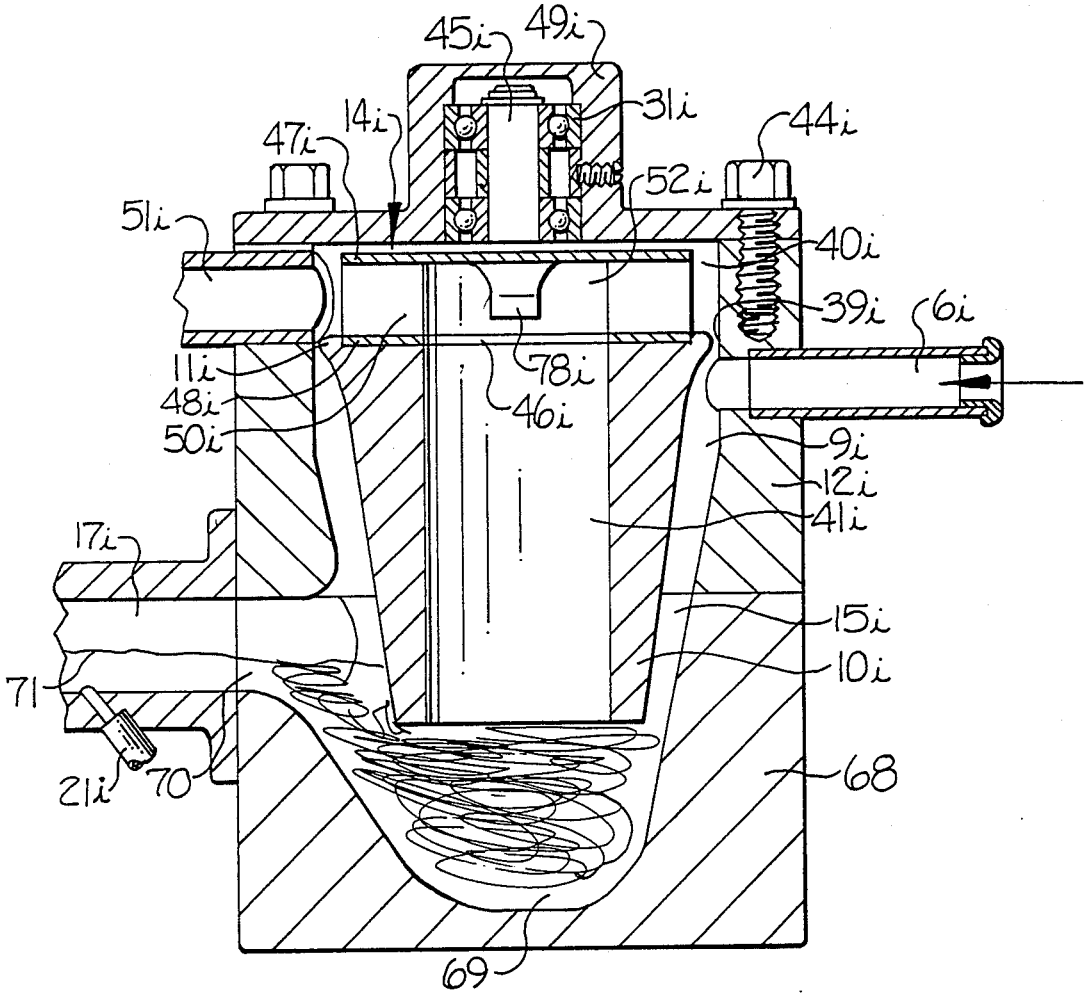
FIG. 13 is a longitudinal sectional view of another embodiment of the apparatus.

The apparatus shown in the alternative embodiment of FIG. 13 is substantially the same as that illustrated in FIG. 7 except for the means for receiving the yarn discharged from housing **12*i*. In the FIG. 13 embodiment of the apparatus, housing 12*i* is provided with an end member 68 having therein a centrally located blind bore or recess 69 from which extends a lateral groove 70. Groove 70 in turn communicates with a yarn outlet duct 17*i* having compressed air injectors 21*i*, only one of which is shown, associated therewith. Yarn windings formed upon roll 10*i* are initially received within recess 69 following their displacement from the free end of the roll. The air flow within end member 68 advances the yarn windings toward the outlet groove 70 and duct 17*i*. Upon encountering the jets of air directed into duct 17*i* by injectors 21*i*, the yarn is placed under tension and transported in a substantially straight condition away from housing 12*i* and member 68**.

Figure 14:
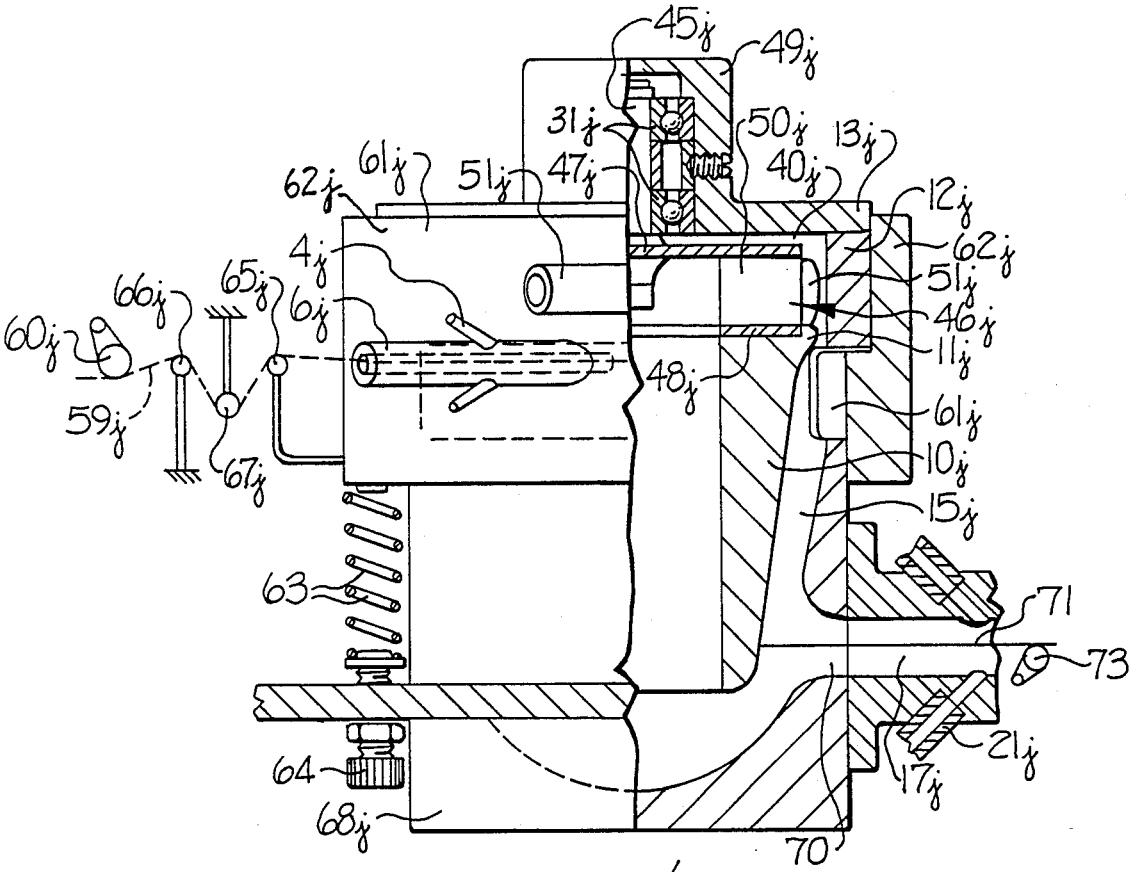
FIG. 14 is a view primarily in longitudinal section, but partially in elevation, of another embodiment of the apparatus in association with a schematically shown yarn feeding and guide system.

The apparatus shown in FIG. 14 is similar to the tension-controlling embodiment of FIG. 11, and is shown in association with identical yarn feeding and guiding components **60*j* and 65*j*, 66*j*, 67*j*. The apparatus differs in that its yarn inlet member 6*j* is in the form of a duct 6*j*, with which pneumatic injectors 4*j* are associated, instead of the yarn entry slot 36*h* (FIG. 14). The apparatus further differs from the apparatus of FIG. 11 in that the components for receiving yarn discharged from its housing 12*j* consist of a housing end member 68*j* and outlet duct 17*j* similar in construction to the components 68 and 17*i* shown in FIG. 13. As is also shown in FIG. 14, the yarn wound upon winding roll 10*j* may if desired be withdrawn directly from such roll in a substantially straight condition along a laterally extending line 71. The illustrated means for so withdrawing the yarn includes the pneumatic injectors 21*j* and also a yarn advancing system 73. In keeping with the apparatus of FIG. 11, that of FIG. 14 automatically controls the yarn tension, and can be adjusted by means of screws 64**.

Figure 15:
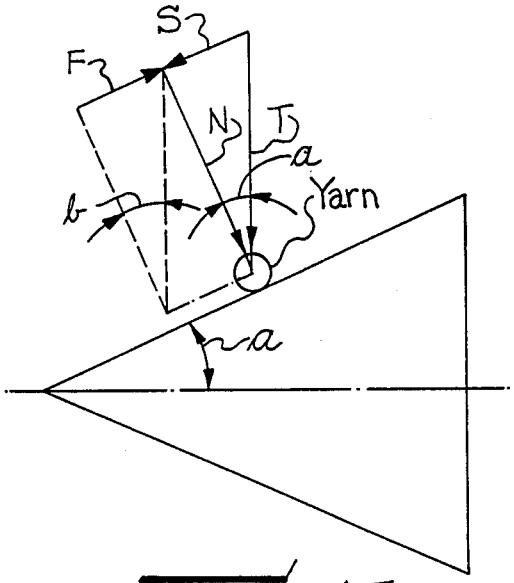
FIG. 15 is a schematic diagram illustrating the relationship between the cone angle a and the angle of friction b.

The phrase "angle of friction" as used herein is further explained by reference to FIG. 15. In FIG. 15, T equals the tension force on the yarn, which results in a normal force N and a slipping force S, with the slipping force S tending to slide the yarn toward the free end of the cone, and with the friction force F resisting such slippage. The cone angle 22 is indicated at a, and is also equal to the angle between T and N as illustrated. Thus the tangent of the cone angle a equals S/N.

By definition, the coefficient of friction of the surface of the roll equals F/N, and the tangent of the illustrated angle of friction b also equals F/N. Thus the tangent of the angle of friction b equals the coefficient of friction, and when the cone angle a is greater than the angle of friction b, S will be greater than F, and the yarn will slip toward the free end of the cone.

The above relationship results in the tension of the yarn causing the yarn to slip downwardly on the cone, without any force being directed on the windings in the downward direction. Also, the tension is self-controlling, since the windings will tend to wind up the roll if the tension is too low, which causes the tension to increase, and the yarn then tends to slip down the roll.

While preferred embodiments of the invention have been shown and described, this was for purposes of illustration only, and not for purposes of limitation, the scope of the invention being in accordance with the following claims.

We claim:

1. A method of withdrawing continuously advancing yarn, with the use of a rotatable tapered roll having a larger diameter end portion and a free opposite end portion of smaller diameter, comprising:

(a) establishing contact between the roll and the yarn at a point upon the larger diameter end portion; while (b) driving the roll at a rate such that the linear speed of the point of initial yarn contact with the roll is at least equal to the delivery speed of the advancing yarn;

(c) forming windings of the yarn about the roll; and (d) selecting the cone angle of the roll to be greater than the angle of friction between the yarn and the roll surface so that the yarn windings are continuously displaced along the length of the roll to and along its smaller diameter end portion.

2. A method as in claim 1, and further including the step of withdrawing the yarn laterally from the smaller diameter end portion of the roll.

3. A method as in claim 1, wherein the yarn windings are displaced from the free end portion of the roll, and further including the step of collecting the displaced yarn windings as a tangled mass.

4. A method as in claim 1, comprising the further step of subjecting the windings upon the roll to a flow of air urging the windings toward and along the free smaller diameter end portion of the roll.

5. A method as in claim 1, including orienting the roll such that its free smaller diameter end portion is lowermost, and said displacement of the yarn windings therealong is assisted by the force of gravity.

6. A method as in claim 1, wherein the roll is driven at a rate such that the linear speed of its point of initial contact with the yarn is greater than the speed of the advancing yarn.

7. A method as in claim 1, including the step of controlling the tension in the advancing yarn by adjusting the location of its initial contact with the roll.

8. A method as defined in claim 1, including the further steps of monitoring the tension of the advancing yarn, and adjusting the location of initial contact between the advancing yarn and the roll in response to changes in the monitored yarn tension.

9. Apparatus for withdrawing continuously advancing yarn, comprising:

a support, a tapered yarn winding roll rotatably mounted to said support and having a larger diameter end portion and a free smaller diameter end portion, means for introducing the advancing yarn substantially tangentially onto said roll, and with said roll having a surface which defines a cone angle which is greater than the angle of friction between the yarn and said surface of said roll, and such that windings of said yarn are adapted to be formed upon said larger diameter end portion thereof, and with said windings being continuously displaced along its length in the direction of said smaller diameter end portion thereof, and drive means mounted to said support for rotating said roll about a central axis at a rate such that the initial point of contact of the yarn upon said larger diameter end portion has a linear speed at least equal to that of the advancing yarn.

10. Apparatus as in claim 9, wherein said roll is a body of rotation of truncated conic shape.

11. Apparatus as in claim 9, wherein said roll extends generally vertically and said smaller diameter free end portion thereof is lowermost.

12. Apparatus as in claim 9, including pneumatic means for inducing a flow of air directed toward the free end of said roll and against the yarn windings upon the tapered roll surface.

13. Apparatus as in claim 9, wherein said roll has an air passageway extending centrally thereof.

14. Apparatus as in claim 9, wherein said drive means includes a high-speed electric motor drivably connected to the larger diameter end of said roll.

15. Apparatus as in claim 14, wherein said motor is a three-phase asynchronous motor.

16. Apparatus as in claim 9, wherein said drive means is pneumatically powered and includes a turbine wheel connected to the larger end of said roll.

17. Apparatus as in claim 9, wherein said support comprises a housing having an end wall, with said roll being mounted within said housing with the larger end portion thereof adjacent said end wall, and wherein said means for introducing the advancing yarn onto said roll includes yarn inlet means for introducing the advancing yarn into said housing and substantially tangentially onto said roll.

18. Apparatus as in claim 17, wherein said yarn inlet means is inclined toward said smaller diameter end portion of said roll.

19. Apparatus as in claim 17, wherein said housing end wall has air channels for directing jets of air along the tapered surface of said roll toward said smaller diameter end portion thereof, said jets of air assisting in the displacement of the windings formed upon said roll.

20. Apparatus as in claim 17, wherein said housing has another wall having an interior surface confronting the tapered surface of said roll, and said another wall has a helical groove extending within and opening from said surface thereof.

21. Apparatus as in claim 20, wherein said interior surface of said another wall defines with the tapered surface of said roll an annular space having a width decreasing in the direction of the free end of said roll.

22. Apparatus for withdrawing continuously advancing yarn, comprising:

a housing;

a tapered yarn winding roll having a larger diameter end portion and an opposite free end portion of smaller diameter, said roll having a surface which defines a cone angle which is greater than the angle of friction between a yarn and said surface of said roll;

bearing means mounting said roll within said housing for rotation about a central axis;

yarn inlet means for introducing the advancing yarn into said housing and onto said larger diameter end portion of said roll;

pneumatic drive means carried by said housing for rotating said roll about said axis at a rate such that its circumferential speed, at its point of initial contact with the advancing yarn, is at least equal to the delivery speed of the advancing yarn;

said roll forming the advancing yarn into windings extending in helical fashion about said roll, and such that said yarn windings are displaced by and axially of said roll in the direction of said smaller diameter end portion thereof.

23. Apparatus as in claim 22, wherein said pneumatic drive means includes a turbine wheel fixedly connected to said roll adjacent the larger diameter end thereof, said housing and said larger diameter roll end defining a chamber about said turbine wheel; and duct means communicating with said chamber for introducing pressurized air therein.

24. Apparatus as in claim 23, wherein said turbine wheel and said winding roll have central passages therein for receiving air from said chamber.

25. Apparatus as in claim 23, wherein said larger diameter roll end has a circumferential bead spaced closely from a confronting interior surface of said housing and defining therewith an annular gap for passage of air from said chamber and into the portion of said housing adjacent the tapered surface of said roll.

26. Apparatus for withdrawing a plurality of yarns advancing toward separated locations, comprising:

a plurality of sequentially connected yarn withdrawal units;

each of said units including a housing having a yarn inlet and a yarn outlet, a tapered yarn winding roll having a free end, means mounting said roll within said housing for rotation about a central axis, and drive means for rotating said roll about said axis;

each of said units being adapted to receive a respective one of said yarns through said yarn inlet thereof, said roll of each said unit forming the yarn received thereby into windings extending about said roll and continuously displaced thereby toward and from said free end thereof, said outlet of said unit receiving the windings displaced from said free roll end;

said units including at least a first unit and a second unit, said second unit having a passage extending therethrough, said passage interconnecting said yarn outlet of said first unit and said yarn outlet of said second unit such that the yarn withdrawn by said first unit and the yarn withdrawn by said second unit both pass to the yarn outlet of said second unit.

27. Apparatus as in claim 26, wherein said second unit includes an annular chamber disposed within said housing adjacent the larger diameter end of said roll, and said drive means includes a turbine wheel drivable connected to said roll and located within said annular chamber, said housing further having channel means for introducing a stream of compressed air into said chamber, and said passageway of said second unit extends through said wheel and said roll.

28. Apparatus as in claim 27, wherein said means mounting said roll of said second unit includes bearing means, and a shaft encircled by said bearing means, said passageway extending through said shaft.

29. Apparatus for withdrawing continuously advancing yarn, comprising:

a housing;

a tapered yarn winding roll rotatably mounted in said housing and having a larger diameter end and a free opposite end of smaller diameter;

drive means mounted to said housing for rotating said roll about a central axis;

yarn inlet means for directing said advancing yarn into engagement with the tapered surface of said roll, said roll being adapted to form said yarn into windings extending about said axis and to continuously displace said windings axially toward said free end of said roll;

and adjustable means for adjustively varying the location axially of said roll of the initial engagement between said advancing yarn and said roll, and for thereby adjustively varying the tension of said advancing yarn, said adjustable means comprising an annular jacket having entry means for guiding the yarn onto the roll, means mounting said jacket to said housing for movement along said central axis, spring biasing means for resiliently biasing said jacket axially toward said larger diameter end of said roll, and yarn guide means mounted to said jacket such that an increased yarn tension moves said jacket toward said free opposite end of said roll and against the force of said spring biasing means.

30. A method of withdrawing continuously advancing yarn, with the use of a rotatable tapered roll having a larger diameter end portion and a free opposite end portion of smaller diameter, comprising:

(a) establishing contact between the roll and the yarn at a point upon the larger diameter end portion; while (b) driving the roll at a rate such that the linear speed of the point of initial yarn contact with the roll is at least equal to the delivery speed of the advancing yarn;

(c) forming windings of the yarn about the roll;

(d) continuously displacing the yarn windings along the length of the roll to and along its smaller diameter end portion, and including subjecting the windings upon the roll to a flow of air urging the windings toward and along the free smaller diameter end portion of the roll.

31. Apparatus for withdrawing continuously advancing yarn, comprising:

a tapered yarn winding roll means having a larger diameter end portion and a free smaller diameter end portion, for forming windings of said yarn upon said larger diameter end portion thereof, and for continuously displacing said windings along its length in the direction of said smaller diameter end portion thereof, and includng pneumatic means for inducing a flow of air directed towards said smaller diameter end portion of said roll and against the yarn windings upon the tapered roll surface, and drive means for rotating said roll about a central axis at a rate such that the initial point of contact of the yarn upon said larger diameter end portion has a linear speed at least equal to that of the advancing yarn.

32. Apparatus for withdrawing continuously advancing yarn comprising:

a housing;

a tapered yarn winding roll having a larger diameter end portion and an opposite free end portion of smaller diameter;

bearing means mounting said roll within said housing for rotation about a central axis;

drive means for rotating said roll about said central axis;

yarn inlet means for introducing the advancing yarn into said housing and onto said larger diameter end portion of said roll, said housing including a blind bore adjacent the free smaller diameter end portion of said roll for initially receiving yarn windings from said roll, duct means for withdrawing said yarn tangentially from said roll, and air jet nozzle means for generating an air flow in said housing from said yarn inlet means to said withdrawing duct means.

33. Apparatus as in claim 17 further comprising yarn outlet means for withdrawing the yarn from said roll and outwardly from said housing, and wherein said yarn outlet means includes air jet nozzle means for generating an air flow from said yarn inlet means through said yarn outlet means and for transporting said windings.

34. Apparatus as in claim 9, wherein said apparatus further comprises web collecting surface means positioned for collecting yarn windings which are released from said free smaller diameter end portion of said roll and for spreading the yarn windings on said surface means as a continuous web.

35. Apparatus as in claim 9, wherein said yarn inlet means includes air jet means for generating a suction at the mouth of said yarn inlet means.

36. Apparatus as in claim 9, further comprising means positioned upstream of said housing for positively feeding the yarn to the said yarn inlet means at a constant speed.

* * * * *